US005842229A

United States Patent [19]

Snedeker

[11] Patent Number: 5,842,229

[45] Date of Patent: Dec. 1, 1998

[54] COLLAR SYSTEM FOR A FIREFIGHTER'S COAT

[75] Inventor: Julie A. Snedeker, Northwood, N.H.

[73] Assignee: Globe Manufacturing Company, Pittsfield, N.H.

[21] Appl. No.: 791,399

[22] Filed: Jan. 30, 1997

[51] Int. Cl.[6] ..... A41D 1/00

[52] U.S. Cl. ..... 2/98; 2/93; 2/81

[58] Field of Search ..... 2/81, 82, 98, 93, 2/85, 87, 129, 135

[56] References Cited

U.S. PATENT DOCUMENTS

| | | | |
|---|---|---|---|
| 4,604,759 | 8/1986 | Bowman et al. | 2/81 |
| 4,768,233 | 9/1988 | Grilliot et al. | 2/81 |
| 5,406,648 | 4/1995 | Butler et al. | 2/81 |

*Primary Examiner*—Gloria Hale

*Attorney, Agent, or Firm*—Watson Cole Stevens Davis P.L.L.C.

[57] ABSTRACT

An outer shell is stitched to the lower edge of an outer collar part which has its upper edge stitched to the upper edge of an inner collar part. The inner collar part has a lower edge stitched to a neck facing which carries a quick-disconnect fastening means for engaging a quick-disconnect fastening means on the upper edge of a separate liner so that the collar portion and the liner can be quickly manually disconnected from and connected to one another. The lower edge of the outer collar part is stitched to the upper edge of a collar facing which is in turn has its lower edge stitched to the outer shell. A moisture barrier has its upper edge stitched to the upper edges of the inner and outer collar parts, while its lower edge is stitched to the lower edge of the collar facing and the outer shell. The moisture barrier extends above and below the upper edge portion of the liner when the collar portion is in an upright position.

17 Claims, 3 Drawing Sheets

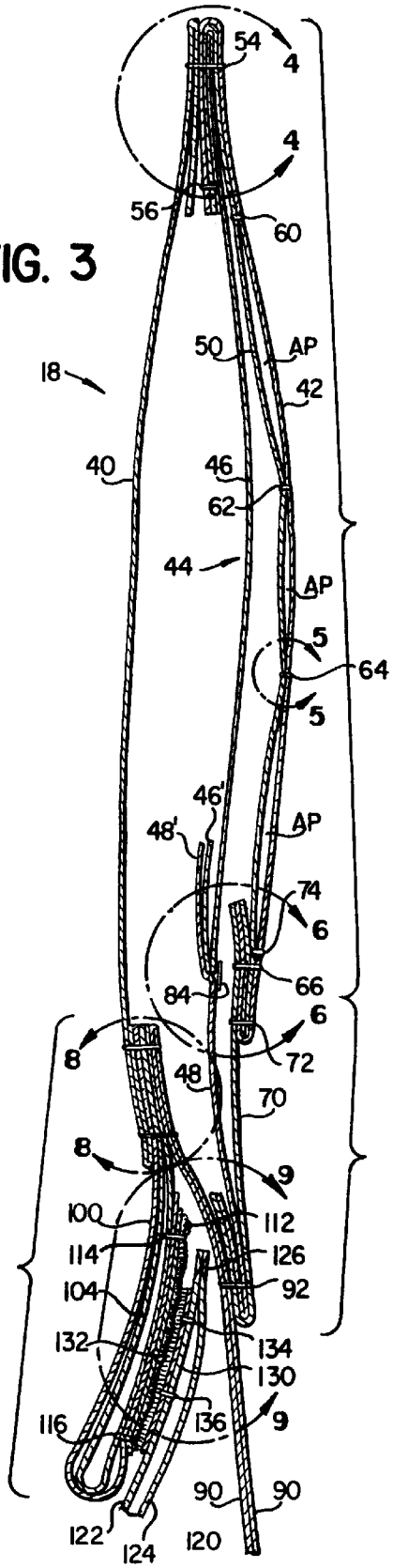
FIG. 3
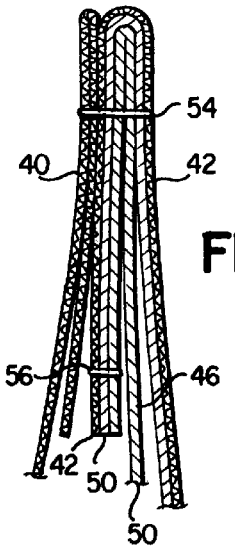
FIG. 4
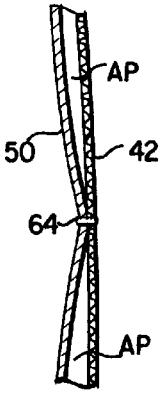
FIG. 5
FIG. 7
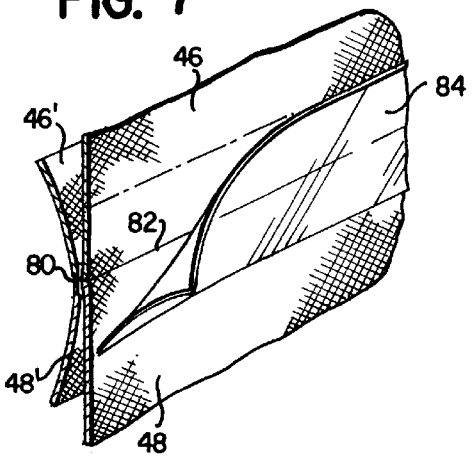

COLLAR SYSTEM FOR A FIREFIGHTER'S COAT

BACKGROUND OF THE INVENTION

The present invention relates to a collar system incorporated into a firefighter's coat. Such coats include an outer shell having a body portion and a collar portion. It is necessary to ensure that water-tight integrity is maintained at the juncture of the outer shell and the collar portion thereof to prevent the firefighter from getting wet when fighting fires wherein copious amounts of water are used which may splash onto the coat.

Another problem which occurs with firefighter's coats is that the thermal liners employed with such coats must be thoroughly washed and dried independently of the outer shell in order to provide a coat which is comfortable to use in firefighting operations. Accordingly, it is highly desirable to provide a liner which is removable from the shell and collar portion so as to enable cleaning protocols to be carried out.

Therefore, it is an objective of the invention to provide a coat which provides water-tight integrity at the juncture of the body portion of the shell and the collar portion of the coat, while providing a construction which permits a separate thermal liner to be removed from the body portion and the collar portion so that the liner can be washed and dried when desired.

U.S. Pat. No. 4,507,806 discloses a construction wherein the collar portion of the coat is permanently secured to the thermal liner, and the collar portion is removably secured to an annular tab at the upper part of the body portion of the outer shell by hook and loop fastening means. This construction does not provide water-tight integrity between the collar portion and the annular tab. Furthermore, the liner cannot be separately washed and dried, but since the collar portion is permanently secured the the thermal liner, it is necessary to disconnect both the liner and collar portion from the body portion of the shell, and the liner and collar portion must be washed and dried together which is undesirable.

U.S. Pat. No. 4,604759 discloses a construction wherein the outer shell, the collar portion, the thermal liner and a waterproof interliner are all permanently interconnected with one another by stitching. This arrangement provides water-tight integrity at the juncture of the outer shell and the collar portion, but the liner cannot be separated and individually washed and dried. Accordingly, the structure of this patent cannot accomplish the desired objectives of the present invention.

SUMMARY OF THE INVENTION

The invention includes inner and outer collar parts which have the upper edges thereof connected to one another. The lower edge of the outer collar part is connected to the upper edge of a collar facing; and the lower edge of the collar facing is connected to the outer shell. The lower edge of the inner collar part is connected to the upper edge of a neck facing and to the outer shell. The neck facing carries a quick-disconnect fastening portion which cooperates with a a quick-disconnect fastening portion carried on the upper edge portion of a separate liner so that the liner may be quickly manually disconnected from or connected to the neck facing when so desired. These fastening portions enable the liner to be completely removed from the shell and the collar portion of the coat. The liner has an outwardly facing moisture barrier layer thereon.

A moisture barrier is disposed between the inner and outer collar parts and is disposed outwardly of the upper edge portion of the liner and also outwardly of the shell. The moisture barrier has the upper edge thereof connected to the upper edges of the inner and outer collar parts, while the lower edge of the moisture barrier is connected to the lower edge of the collar facing and the outer shell. The moisture barrier extends above and below the upper edge portion of the liner when the collar portion is in an upright position as employed when fighting fires.

A further layer of moisture barrier material is disposed between the moisture barrier and the outer collar part. Stitching connects this further layer to spaced locations on the outer collar part to form thermally insulating air pockets. The upper edge of the further layer is connected to the upper edges of the inner and outer collar parts, while the lower edge thereof is connected to the lower edge of the outer collar part and the upper edge of the collar facing.

If water should seep through the stitching which forms the air pockets, it will run down the outer face of the moisture barrier. Any small amount of water which might seep through the stitching which connects the shell to the moisture barrier and the collar facing will run down the outwardly facing moisture barrier layer of the liner and drain from between the separated bottom edges of the shell and liner.

BRIEF DESCRIPTION OF THE DRAWINGS

FIG. 3 is a sectional view on an enlarged scale taken on line 3—3 of FIG. 1;

FIG. 4 is an enlarged view of the portion 4—4 of FIG. 3;

FIG. 5 is an enlarged view of the portion 5—5 of FIG. 3;

FIG. 7 is a top perspective view of a portion of the structure shown in FIG. 6;

DESCRIPTION OF THE PREFERRED EMBODIMENT

Figure 1:
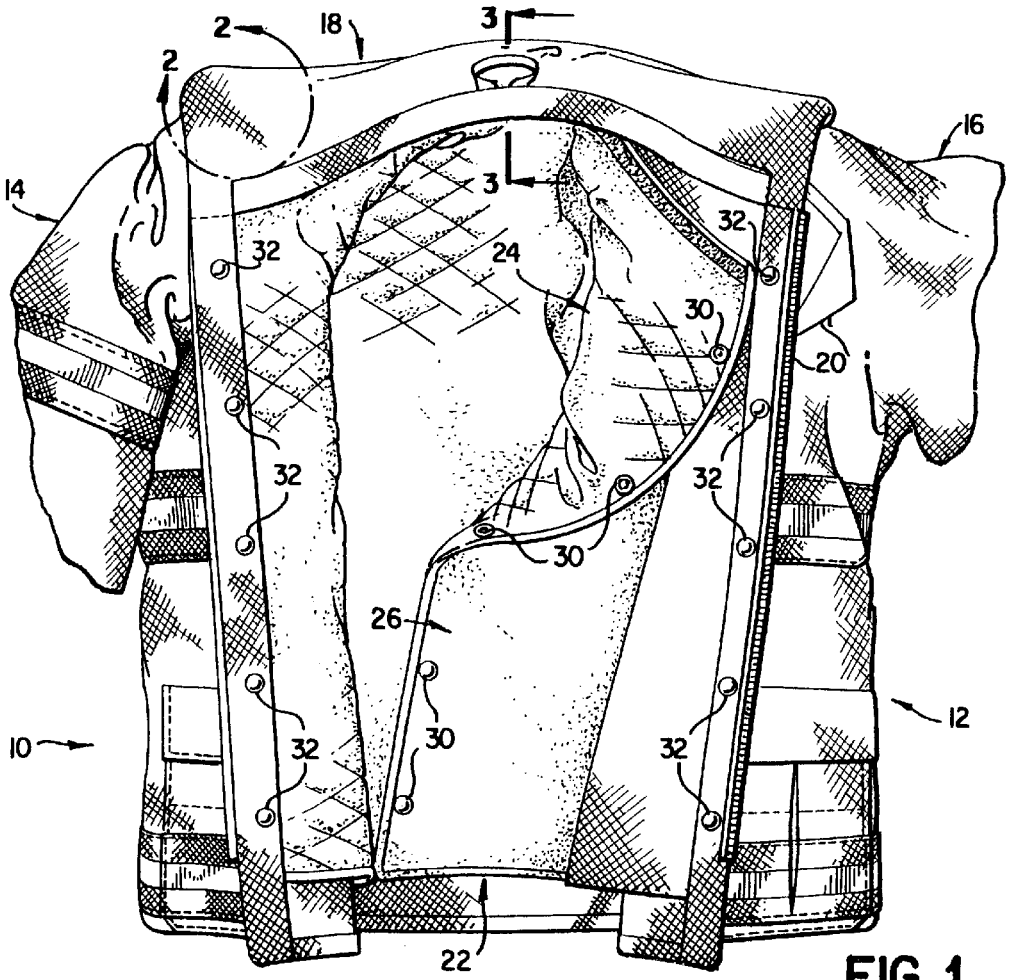
FIG. 1 is a front view of a firefighter's coat incorporating the collar system of the invention, and showing the coat in opened position.

Referring now to the drawings wherein like reference characters designate corresponding parts throughout the several views, there is shown in FIG. 1 a firefighter's coat 10 having a flame resistant shell formed of a conventional material and which defines a body or torso portion 12 having permanently stitched thereto a right sleeve 14 and a left sleeve 16. A collar portion 18 is permanently stitched to the upper part of the torso portion of the shell.

The coat is shown in open position in FIG. 1, and is adapted to be closed by a zipper, one portion 20 of which is visible in this figure. A liner 22 includes the usual inner quilted layer 24 of thermal insulating material and an outer moisture barrier layer 26. The liner is connected at the opposite vertical edges thereof to the the opposite vertical edge portions of the body portion of the shell by a plurality of conventional snap fasteners 30 mounted on the liner which are adapted to be connected to cooperating snap fasteners 32 mounted on the body portion of the shell.

Figure 2:
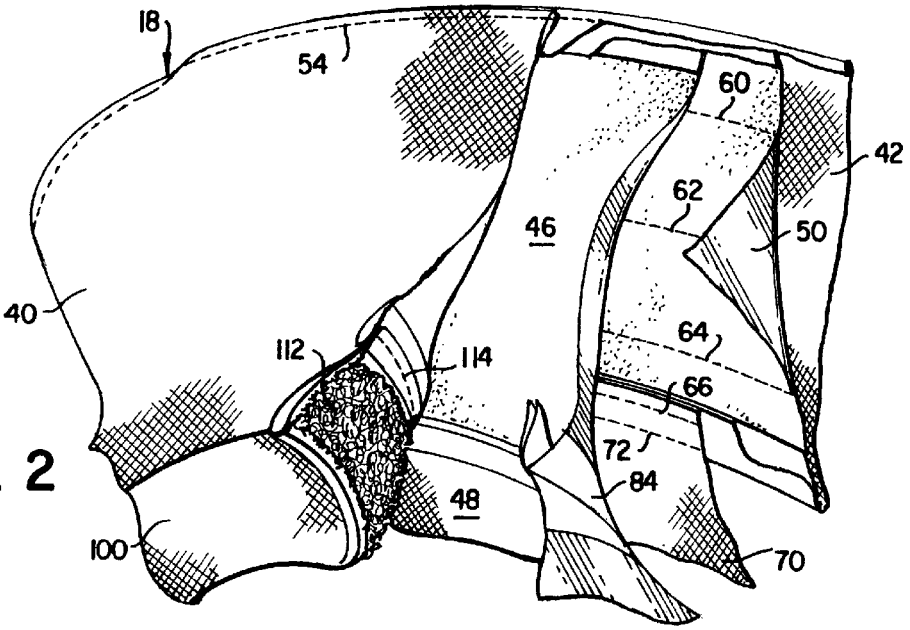
FIG. 2 is an enlarged view of the portion 2—2 of FIG. 1 with parts of the structure cut away and folded back for clarity of illustration.

Referring to FIGS. 2, 3 and 4, the collar portion includes an inner collar part 40 and an outer collar part 42 each of which may be made of the same material as the shell. A moisture barrier indicated generally by reference numeral 44 includes an upper portion 46 and a lower portion 48 which are connected to one another as described hereinafter. The moisture barrier is formed of two portions to ensure that the lower edge of the moisture barrier follows the contours of the neck and shoulders of a wearer such that the moisture barrier will lie without wrinkles when the collar portion is in an upright operative position. The moisture barrier material is conventional and comprises a breathable moisture barrier fabric. The waterproof surface of moisture barrier 44 faces outwardly toward the outer collar part 42.

A further layer of moisture barrier material 50 is formed of the same material as moisture barrier 44 and the waterproof surface thereof faces outwardly toward the outer collar part 42. The inner and outer collar parts 40 and 42 as well as the moisture barrier 44 and layer 50 extend laterally from one end of the collar to the other so as to provide waterproof integrity throughout the collar.

As seen in FIG. 4, the upper edges of the outer collar part 42, the inner collar part 40, upper moisture barrier portion 46 and layer 50 are all turned over and stitched to one another by a line of stitching 54. In addition, the outermost edges of the outer collar part 42, layer 50 and upper moisture barrier portion 46 are further stitched together by a line of stitching 56.

Figure 6:
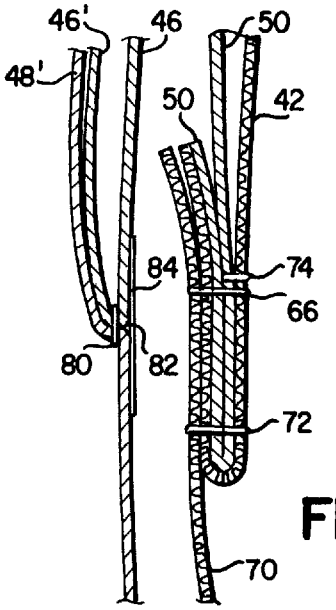
FIG. 6 is an enlarged view of the portion 6—6 of FIG. 3.

As seen in FIG. 3, layer 50 is connected to the outer collar part by spaced lines of stitching 60, 62, 64 and 66 to form air pockets AP between the outer collar part and layer 50, the upper and lower edges of the air pockets being defined by the lines of stitching. An enlarged view of stitching 64 is shown in FIG. 5. These air pockets serve as thermal insulation during use of the coat. As seen in FIG. 6, the line of stitching 66 passes through the turned up lower edges of the outer collar part 42 and layer 50 and also passes through the upper edge of a collar facing 70. A further line of stitching 72 passes through the same pieces of material as line of stitching 66. Another line of stitching 74 passes through pieces of material 42 and 50 just above the line of stitching 66.

As seen in FIG. 6 and 7, the lower edge 46' of the upper moisture barrier portion 46 is connected to the upper edge 48' of the lower moisture barrier portion 48 by a line of stitching 80 so as to define a seam 82. In order to prevent moisture from seeping through this seam, a strip of material or tape 84 is heat sealed to the outwardly facing surfaces of elements 46 and 48 and extends a substantial distance on either side of the seam. The strip has a substantially waterproof surface which faces outwardly toward the outer collar part.

Figure 9:
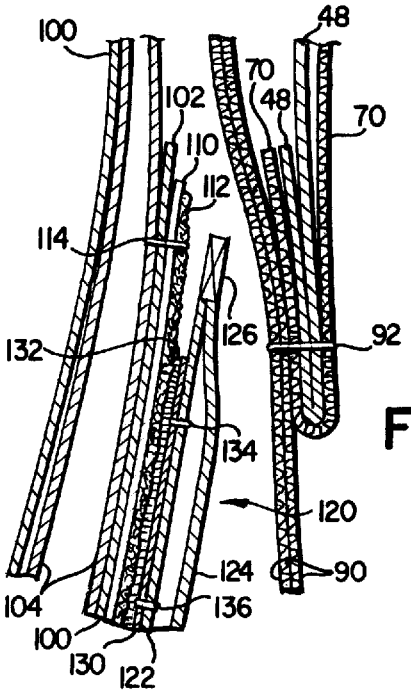
FIG. 9 is an enlarged view of the portion 9—9 of FIG. 3.

As seen in FIGS. 3 and 9, the lower edge of collar facing 70 and the lower portion 48 of the moisture barrier are turned up and are connected to a double thickness shell portion 90 by a line of stitching 92.

Figure 8:
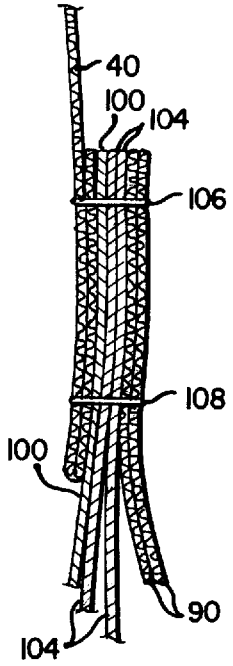
FIG. 8 is an enlarged view of the portion 8—8 of FIG. 3.

Referring to FIG. 3 and 8, a neck facing comprises a portion 100 formed of a fabric which is soft enough so that it will not irritate the neck of a wearer and which has the general configuration of a loop, although the loop is not closed as will become apparent. Portion 100 of the neck facing extends downwardly from the lower edge of the inner collar part 40 and is folded back upwardly and terminates at an edge 102 which is seen most clearly in FIG. 9. The neck facing includes a complete loop of material 104 disposed within portion 100 as seen in FIGS. 3. Loop 104 has a substantially waterproof surface on the outside thereof.

As seen particularly in FIG. 8, the lower edge of inner collar part 40 is doubled over and is connected by two lines of stitching 106 and 108 with the upper edge of neck facing 100 and the double thickness shell portion 90 as well as the opposite end edges of loop 104.

As seen in FIGS. 3 and 9, a strip of material 110 carries a fastening portion 112 of a quick-disconnect fastening means preferably comprising a hook and loop fastening means such as VELCRO. Strip 110 is connected to portions 100 and 104 of the neck facing by means of two lines of stitching 114 and 116.

A separate liner 120 includes the usual inner quilted layer 122 for thermal protection and an outwardly facing moisture barrier layer 124 formed of the same material as the moisture barrier previously described. The two layers are stitched together at the top edges thereof by stitching 126. The remaining edges of the two layers are also stitched together by suitable stitching so that layers 122 and 124 are connected together only at the edges thereof. As seen in FIG. 9, a strip of material 130 carries a fastening portion 132 of a quick-disconnect fastening means such as VELCRO which is adapted to cooperate with fastening portion 112 so as to quickly manually disconnect the upper edge portion of the liner from the collar portion or quickly manually connect the upper edge portions of the liner and the collar portion when desired. The strip of material 130 is connected to the inner layer 122 of the liner by two lines of stitching 134 and 136. It is noted that the lines of stitching 134 and 136 do not penetrate the moisture barrier layer 124 of the liner.

When the collar portion is disposed in the upright operative position shown in FIG. 3, any moisture which might seep through the lines of stitching 60, 62, 64 and 66 will run down the outwardly facing surface of the moisture barrier until it reaches the turned over portion of the lower edge of the lower portion 48 of the moisture barrier as seen in FIG. 9. If any moisture should seep through the stitching 92, it will then run down the outwardly facing moisture barrier layer 124 of the liner and thence outwardly of the coat between the shell and liner. In this manner, the collar portion ensures that substantially no moisture will be transmitted to the inner collar part or the neck facing during use.

The invention has been described with reference to a preferred embodiment. Obviously, various modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. A collar system for a firefighter's coat, said coat comprising, a flame resistant shell including a body portion having left and right sleeve portions and and having a collar portion permanently secured to said body portion, a separate liner having an upper edge portion and an outwardly facing moisture barrier layer, means for connecting said liner to said body portion, quick-disconnect fastening means for quickly manually disconnecting the upper edge portion of said liner from said collar portion or quickly manually connecting the upper edge portions of said liner to said collar portion, and a moisture barrier disposed outwardly of the upper edge portion of said liner and outwardly of the adjacent portion of the shell.

2. A collar system as defined in claim 1 wherein said moisture barrier extends above and below said upper edge portion of the liner when the collar portion is in an upright position.

3. A collar system as defined in claim 1 wherein said quick-disconnect fastening means includes a first fastening portion supported by the upper edge portion of said liner and a second cooperating fastening portion supported by said collar portion.

4. A collar system for a firefighter's coat, said coat comprising a flame resistant shell including a body portion having left and right sleeve portions, a collar portion including an outer collar part and an inner collar part, said outer collar part being permanently connected to said inner collar part and said body portion, a separate liner, said liner having an upper edge portion and an outwardly facing moisture barrier layer, quick-disconnect fastening means for quickly manually disconnecting the upper edge portion of said liner from said collar portion or quickly manually connecting the upper edge portion of said liner to said collar portion, and a moisture barrier disposed between said inner and outer collar parts and being disposed outwardly of the upper edge portion of said liner and outwardly of the adjacent portion of said shell.

5. A collar system as defined in claim 4 wherein said outer collar part is connected to said body portion by a separate collar facing.

6. A collar system as defined in claim 4 wherein said moisture barrier extends above and below the upper edge portion of said liner when the collar portion is is an upright position.

7. A collar system as defined in claim 4 wherein said inner collar part has an upper edge and a lower edge, and including a neck facing connected to the lower edge of said inner collar part.

8. A collar system as defined in claim 7 wherein said quick-disconnect fastening means includes a first fastening portion supported by the upper edge portion of said liner and a second cooperating fastening portion supported by said neck facing.

9. A collar system for a firefighter's coat, said coat comprising a flame resistant shell including a body portion having left and right sleeve portions and having a collar portion permanently secured to said body portion, said collar portion including an outer collar part and an inner collar part, said collar parts each having an upper edge and a lower edge, the upper edges of said collar parts being permanently connected together, a neck facing permanently connected to the lower edge of said inner collar part, a collar facing permanently connected to the lower edge of said outer collar part and to said body portion, a separate liner having an upper edge portion and an outwardly facing moisture barrier layer, a quick-disconnect fastening means for quickly manually disconnecting the upper edge portion of said liner from said neck facing or for quickly manually connecting the upper edge portion of said liner to said neck facing, and a moisture barrier disposed between said inner and outer collar parts and being disposed outwardly of the upper edge portion of said liner and outwardly of the adjacent portion of said body portion.

10. A collar system as defined in claim 9 wherein said moisture barrier has an upper edge and a lower edge, the upper edge of said moisture barrier being permanently connected to said inner and outer collar parts, the lower edge of said moisture barrier being permanently connected to said body portion.

11. A collar system as defined in claim 10 wherein the lower edge of said moisture barrier is also connected to said collar facing.

12. A collar system as defined in 9 including a further layer of moisture barrier material disposed inwardly of and adjacent said outer collar part, and stitching means for connecting said further layer of material to spaced locations on said outer collar part to form air pockets between said outer collar part and said further layer of material for providing thermal insulation.

13. A collar system as defined in claim 9 wherein said further layer of material includes a lower edge, said collar facing having an upper edge, the lower edges of said outer collar part and said further layer of material being connected to the upper edge of said collar facing.

14. A collar system as defined in claim 9 wherein said moisture barrier extends above and below said upper edge portion of the liner when the collar portion is in an upright position.

15. A collar system as defined in claim 9 wherein said quick-disconnect fastening means includes a first fastening portion supported by the upper edge portion of said liner, and a second cooperating fastening portion is supported by said neck facing.

16. A collar system as defined in claim 9 wherein said neck facing comprises a first loop of material and a second loop formed of substantially waterproof material disposed within said first loop of material, said second loop having a substantially waterproof surface formed on the outside of said second loop of material.

17. A collar system as defined in claim 9 wherein said moisture barrier includes an upper portion and a lower portion, said upper portion being stitched to said lower portion, and a strip of substantially waterproof material being sealed to said upper and lower portions of said moisture barrier to maintain an effective moisture barrier adjacent said stitching.

* * * * *